US011059087B2

(12) United States Patent
Hofstetter et al.

(10) Patent No.: US 11,059,087 B2
(45) Date of Patent: Jul. 13, 2021

(54) METHOD FOR PRODUCING STAMPED PARTS

(71) Applicant: Feintool International Holding AG, Lyss (CH)

(72) Inventors: Sven Hofstetter, Aarberg (CH); Herbert Fuchs, Diessbach (CH); Jonatan Gersbach, Messen (CH)

(73) Assignee: FEINTOOL INTERNATIONAL HOLDING AG, Lyss (CH)

( * ) Notice: Subject to any disclaimer, the term of this patent is extended or adjusted under 35 U.S.C. 154(b) by 196 days.

(21) Appl. No.: 15/993,049

(22) Filed: May 30, 2018

(65) Prior Publication Data

US 2018/0345350 A1 Dec. 6, 2018

(30) Foreign Application Priority Data

May 30, 2017 (EP) ..... 17000913

(51) Int. Cl.

| | |
|---|---|
| ***B21D 28/16*** | (2006.01) |
| ***B21D 28/26*** | (2006.01) |
| ***B21D 19/00*** | (2006.01) |
| *B21D 53/28* | (2006.01) |

(52) U.S. Cl.

CPC ..... *B21D 28/26* (2013.01); *B21D 19/005* (2013.01); *B21D 28/16* (2013.01); *B21D 53/28* (2013.01)

(58) Field of Classification Search

CPC ..... B21D 28/16; B21D 19/005; B21D 53/28; B21D 28/26; Y10T 29/49472; Y10T 29/49467; Y10T 29/49462; Y10T 29/49478

USPC ..... 72/336, 337, 329, 330; 29/893.33, 29/893.34

See application file for complete search history.

(56) References Cited

U.S. PATENT DOCUMENTS

| | | | | |
|---|---|---|---|---|
| 4,586,360 A * | 5/1986 | Jurgensmeyer | ..... | B21D 28/16 29/893.33 |
| 6,125,527 A * | 10/2000 | Sunaga | ..... | B21D 28/16 29/558 |
| 6,212,930 B1 | 4/2001 | Skrabs et al. | | |
| 7,464,575 B2 * | 12/2008 | Miyahara | ..... | B21D 28/02 72/329 |

(Continued)

FOREIGN PATENT DOCUMENTS

| | | |
|---|---|---|
| JP | 63126625 A * | 5/1988 |
| JP | S63-126625 A | 5/1988 |
| JP | 05154598 A * | 6/1993 |

(Continued)

OTHER PUBLICATIONS

Technical Tidbits, "Strain Hardening & Strength", May 2010, Brush Wellman Inc., Issue No. 17 (Year: 2010).*

(Continued)

*Primary Examiner* — Adam J Eiseman
*Assistant Examiner* — Dylan Schommer
(74) *Attorney, Agent, or Firm* — Norris McLaughlin, P.A.

(57) ABSTRACT

A stamped or fine-blanked, workpiece is inserted in an embossing device, and the burr created on the workpiece during stamping or fine blanking is rounded by way of a die of the embossing device and the height of the rollover created during stamping or fine blanking is decreased using the same stroke of the embossing device by way of which the burr rounding is carried out.

3 Claims, 5 Drawing Sheets

(56) References Cited

U.S. PATENT DOCUMENTS

| | | | | |
|---|---|---|---|---|
| 2008/0014036 | A1* | 1/2008 | Ueki | B21D 28/16 409/1 |

FOREIGN PATENT DOCUMENTS

| | | | | | |
|---|---|---|---|---|---|
| JP | H05-154598 | A | | 6/1993 | |
| JP | H11-244954 | A | | 9/1999 | |
| JP | 2004-322144 | A | | 11/2004 | |
| JP | 2005-517533 | A | | 6/2005 | |
| JP | 2007198450 | A | * | 8/2007 | |
| JP | 2009-241091 | A | | 10/2009 | |
| WO | 97/32678 | A1 | | 9/1997 | |
| WO | WO-03069185 | A1 | * | 8/2003 | F16G 5/16 |

OTHER PUBLICATIONS

Franklin Jones, Planing and Milling: A Treatise On the Use of Planers, Shapers, Slotters, and Various Types of Horizontal and Vertical Milling Machines and Their Attachments, 1915, The Machinery Publishing Co., LTD., First Edition, p. 227 (Year: 1915).*

F. Klocke, Manufacturing Processes 4, 2013, Springer-Verlag Berlin Heidelberg, RWTH edition, pp. 434 and 435 (Year: 2013).*

* cited by examiner

METHOD FOR PRODUCING STAMPED PARTS

BACKGROUND OF THE INVENTION

The invention relates to a method for producing stamped parts, in which a stamped, and in particular a fine-blanked, workpiece is inserted in an embossing device, and the burr that was created on the workpiece during stamping, and in particular fine blanking, is rounded using a die of the embossing device.

A method of this type is known, for example, from the publication WO 97/32678 (U.S. Pat. No. 6,212,930) by the applicant itself.

The problem underlying this method of the type in question is that so-called rollover is present on a workpiece, which is to be stamped or fine-blanked out of a sheet metal strip, for example, along the cutting contour on the one surface of the workpiece thus produced, and that a burr is present along the stamping or cutting contour on the opposite workpiece surface. Especially the burr protruding from the workpiece surface on the edge in the stroke direction prevents immediate use of such a stamped or fine-blanked workpiece, and instead requires a finishing operation.

The method of the type in question causes the workpiece produced as a stamped part, which is inserted into the embossing device, to be freed of the burr by way of an embossing operation in a die. Essentially, the burr is rounded here, and the rounding is, in particular, predetermined by the die of the embossing device.

Despite this elimination of the burr on a workpiece thus produced, this workpiece, according to existing prior art often requires finishing, for example by way of grinding, since the mashed burr side of the workpiece and the die-roll side of the workpiece have slightly different shapes or dimensions, which can also be attributed, for example, to the fact that the rollover predefined by the stamping parameters and the material is not identical to the burr rounded by the embossing operation, and furthermore the sheared edge of the workpiece extending between the two workpiece surfaces, which is to say between the die-roll side and the burr side of the workpiece, is also not oriented exactly parallel to the stroke direction of the press, or not exactly parallel to the surface normal of the two workpiece surfaces of the produced workpiece.

In particular, the workpiece thus produced generally has a smaller cross-sectional surface area in the die-roll-side workpiece surface plane than in the burr-side workpiece surface plane.

SUMMARY OF THE INVENTION

It is an object of the present invention to reduce the geometric deviations of a workpiece (partially finished part), produced by way of stamping or fine blanking, between the die-roll-side workpiece surface plane and the burr-side workpiece surface plane, at least with respect to one of the two above-described causes, and preferably with respect to both described causes, and particularly preferably to completely eliminate these and thereby finish producing the part.

It is furthermore a preferred object of the invention to use a method of the type mentioned at the outset, which follows a stamping or fine blanking process, to produce a workpiece that is ready for use without further finishing, or with, at most, a considerably reduced need for finishing compared to the existing prior art.

According to the invention, this object is achieved in that, in a method of the type mentioned at the outset, the height of the rollover created during stamping is also reduced by way of the same stroke of the embossing device which is used to round the burr on the burr-side workpiece surface. The height of the rollover shall be understood to mean the length of the rollover extent on the cut edge in the direction of the workpiece thickness or in the stroke direction of the stamping press or fine blanking press.

Here, the invention can provide that the die rounding the burr has a radius, intended for burr rounding, which is smaller than the rollover height of the rollover created during stamping, and in particular during fine blanking, and that reduced rollover is created on the die-roll-side by the stamping operation, and in particular is decreased to a rollover height that, at least substantially, is equal to the aforementioned radius of the die. The reduction in rollover is essentially achieved by pressing the material of the workpiece, during embossing or rounding of the burr, in the direction of the rollover.

The invention can provide, for example, that a die has a one-piece, two-piece or also multi-piece design and, for example, comprises an upper die part and a lower die part, wherein the rounding of the burr on the burr side of the workpiece is achieved by one of the two die parts, and the decrease in the rollover height on the die-roll-side of the workpiece is achieved by the other die part, or the material flow decreasing the rollover height is limited by the other die part when the embossing operation of the workpiece takes place in the aforementioned multi-piece die.

According to a particularly preferred embodiment, the rounding of the burr-side cut edge of the workpiece, after the embossing operation, has the same, or at least substantially the same, radius as the cut edge on the die-roll side of the workpiece having reduced rollover. "Substantially" here shall be understood to mean that a deviation between these two radii, or the embossed radius and the reduced rollover height, is <25%, more preferably <15%, and still more preferably <5%.

In this way, it is achieved, by the invention, that rounded burr-side and die-roll-side cut edges are present on the workpiece which are, if not completely, at least substantially identical in terms of the geometrical design, which is conducive to the workpiece produced being suitable for immediate use.

The method according to the invention can be used to finish essentially any stamped or fine-blanked workpiece by way of embossing. The embossing can take place chronologically after the stamping, and in particular the fine blanking, but preferably takes place in the same press, so that both a stamped, and in particular fine-blanked, workpiece and an embossed workpiece, which is, in particular, immediately ready for use, is created using one and the same stroke of this press, wherein, between two strokes, the stamped, and in particular fine-blanked, workpiece is transferred from the stamping region of the press into the embossing region of the same press.

The embossing device of such a press can thus form what is known as a compound tool, which is always used chronologically after the stamping, and in particular fine blanking, but always using the same stroke that is used to bring about the stamping, and in particular fine blanking.

The invention, however, is not limited to this preferred embodiment, and can likewise provide for the embossing device to be an entirely separate device from the stamping press, and in particular fine blanking press.

Independently of the above-described reduction of the rollover, however, particularly preferably, the invention can provide, in combination therewith, that the same stroke of the embossing device, by way of which the burr rounding takes place, is also used to decrease, and in particular completely eliminate, the angle between a tangent of the sheared edge, which extends between the burr side and the die-roll side of the workpiece, and the workpiece normal. In workpieces that have a circular contour this means that the conicity of the sheared edge is decreased, and preferably eliminated.

The above-described tangent is preferably understood to mean such a tangent which, in the thickness direction of the workpiece, is essentially placed against the sheared edge, the intersecting points of the tangent with the die-roll-side and burr-side workpiece surface planes thus having a minimum distance. Such a tangent forms an angle with the workpiece normal of the workpiece which is larger before the embossing operation is carried out than after the embossing operation. Preferably, such a tangent and the workpiece normal are parallel to one another after the embossing operation.

The invention can provide that the above-described decrease in the aforementioned angle is made at any point along a circumferential direction of the stamped, and in particular fine-blanked, workpiece. Such an angular reduction can take place both on the outer and the inner cutting or stamping contours of the workpiece.

However, the invention can also provide that the described angular reduction takes place only in selected predetermined positions along the circumferential direction of a cutting contour, and in particular an outer or inner cutting contour, however in particular not in all circumferential positions. Such an angular reduction can be limited, for example, to those positions of a generated sheared edge of a workpiece which require particularly high precision or dimensional accuracy on the workpiece to be later used, in particular wherein the angular reduction of the sheared edge with respect to the workpiece normal is dispensed with in other positions that do not require such dimensional accuracy or precision, so that the embossing according to the invention, with such only partial angular reduction, for example, can also take place more quickly and/or with less wear of the tools used, compared to an angular reduction along all possible circumferential positions of the cutting contour.

The method according to the invention can be used to treat any stamped or fine-blanked workpiece. The method according to the invention is not limited to a certain contour shape of the at least one cutting contour of the stamped, and in particular fine-blanked, workpiece.

However, in a particularly preferred application, the invention provides for the embossing according to the invention to be carried out with disks used in automatic transmissions, for example of motor vehicles, and/or with gear wheels, and in particular with sprockets used to drive link chains, or with workpieces that comprise teeth at least in sections, and in particular on the outer contour.

In particular in the application with workpieces comprising stamped, and preferably fine-blanked, teeth, in particular gear wheels, and preferably sprockets, the invention can provide that a reduction of the rollover and a reduction of the angle of the sheared edge, or a tangent thereon, relative to the workpiece normal are implemented on respective different circumferential positions of the cutting contour of the workpiece.

For example, a reduction in rollover can be implemented in certain first positions of a cutting contour located in the circumferential direction, and the aforementioned angular reduction can be implemented in other second positions along the circumferential direction of the cutting contour.

The invention can also provide that both a reduction in rollover and an angular reduction of the sheared edge in certain third positions present in the circumferential direction are implemented.

In particular in the application with workpieces comprising teeth, in particular gear wheels, and preferably sprockets, and with transmission disks, the respective first or respective second and/or respective third positions can have an equidistant angular separation from one another, and in particular in the circumferential region of the workpiece in which teeth are disposed.

However, again, the invention is not limited to the application with transmission disks or gear wheels, but applies in general and can be used with any type or shape of stamped, and preferably fine-blanked, workpieces, in particular with any asymmetrical workpieces, and preferably with rotationally symmetrically stamped, and in particular fine-blanked, workpieces, or with n-fold rotationally symmetrically stamped, and preferably fine-blanked, workpieces. The aforementioned transmission disks or gear wheels represent special instances of such an n-fold rotationally symmetrical design of workpieces.

In conjunction with the reduction of the rollover according to the invention, and also in conjunction with the reduction of the angle of the sheared edge with respect to the workpiece normal according to the invention, and particularly preferably with the combined implementation of both a rollover reduction and an angular reduction, the invention is preferably refined by the following further described embodiments.

The invention can provide, for example, that the die of the embossing device moves over the burr, coming from the burr side of the workpiece, with an undersized dimension relative to the workpiece, and in particular to the position of the burr on the workpiece. In particular, the aforementioned undersized dimension shall be understood to mean that the inner free cross-sectional surface area of the die, or at least a portion of a multi-piece die, has a free cross-sectional surface area that is smaller than the burr-side cross-sectional surface area of the workpiece in the burr-side workpiece surface plane.

In actuality, this means that the stamped, or fine-blanked, workpiece cannot be inserted in the embossing device in a free-falling manner, but that radial and/or axial material displacement of workpiece material takes place in areas where an undersized dimension exists.

This material displacement, which is limited by the geometric dimensions of the die, can be used, for example, to achieve the reduction in the angle between the aforementioned tangent of the sheared edge and the workpiece normal.

The undersized dimension here is thus viewed essentially in a direction parallel to the workpiece surfaces between the radially outer workpiece sheared edges and the radially inner die surfaces, or conversely between radially inner workpiece sheared edges and radially outer die surfaces. The die surfaces considered here are surfaces of the die located parallel to the stroke direction or workpiece normal.

The described embossing with the aforementioned undersized dimension essentially results in the above-described angular reduction between a tangent of the sheared edge and the workpiece normal.

In this embodiment of embossing with a present undersized dimension as well, it may be provided that the undersized dimension is not present across the entire circumferential length of the stamping contour or cutting contour of a workpiece between the workpiece and the die. In particular, in conjunction with the above-described embodiments, in which an angular reduction of the sheared edge with respect to the workpiece normal is only required in certain positions, the invention can provide that the aforementioned undersized dimension is only present in the region of these positions.

In this way, there may be positions distributed on the die in the circumferential direction which have an undersized dimension in relation to the workpiece.

In other positions, the same die may have the same dimension, or an oversized dimension, in relation to the workpiece, so that, in these positions, essentially no angular reduction of the sheared edge takes place, or this is at least not generated by a radial material displacement of workpiece material.

In conjunction with the embodiment of an undersized dimension between the die of the embossing device and the workpiece, the invention can provide that the material of the workpiece is displaced toward the workpiece interior and/or toward the die-roll side by way of an abutment chamfer on the die which is oriented toward the workpiece.

This embodiment can thus be used to generate both the angular reduction according to the invention of the sheared edge with respect to the workpiece normal, and the above-described reduction of the rollover.

In a preferred embodiment, the invention provides here that the absolute magnitude of the undersized dimension corresponds to at least 50% of the distance which, measured in a direction parallel to the workpiece plane, is present on the stamped workpiece, and in particular on the fine-blanked workpiece, on the sheared edge between the die-roll end and the burr tip.

In a further preferred embodiment, the invention can also provide that the die of the embossing device is used to emboss, abutting the rounded burr, an edge extending along the burr-side stamping contour, and in particular fine blanking contour, in the region of which the workpiece thickness is reduced compared to a workpiece region located outside this edge.

In particular, this generation of an edge can also result in strain hardening of the workpiece in the edge region. Such an embodiment of the generation of a thickness-reduced edge along the stamping or fine blanking contour is preferably implemented with sheet metals having a thickness of <2 mm, preferably <1.5 mm, and still more preferably <1 mm.

In particular, this embossing of a thickness-reduced edge can also result in the height of the rollover located opposite the edge on the other side of the workpiece being reduced due to material displacement in the axial direction or stroke direction. This refinement according to the invention can also contribute to a rollover reduction on the workpiece, or even bring this about on its own.

In general, but particularly preferably in conjunction with the above-described embodiment of the generation of a thickness-reduced edge, the invention can provide that the die of the embossing device, coming from the burr side and moving over the burr and rounding the same, is designed as a bell or sleeve.

The term bell or sleeve shall not imply here that the cross-section of the die perpendicular to the stroke direction is rotationally symmetrical, although this may be provided, but only that the die, with lateral wall regions, encloses an interior region into which the workpiece is lowered during embossing.

Such a die, and in particular bell or sleeve, can surround one of two ejectors, between which the workpiece to be embossed is clamped during rounding of the burr. By clamping the workpiece between two ejectors, the majority of the workpiece surface is not influenced by the embossing operation, and the embossing, due to the bell-shaped or sleeve-shaped design of the die, affects only the region of the stamping or fine blanking contour.

In a particularly preferred refinement, the invention provides that the embossing device comprises an upper die part and a lower die part, the distance of which with respect to one another, viewed in the stroke direction, decreases in a direction perpendicular to the stroke direction, and in particular from die interior to the die edge and, based on the workpiece, thus decreases from the workpiece interior to the sheared edge of the workpiece, and preferably by way of the same stroke of the embossing device during which the burr rounding takes place, workpiece thickness reduction, which increases in a direction toward the sheared edge, is also produce on the workpiece on the burr side and die-roll side.

The method variant according to the invention is particularly preferably used to produce workpieces comprising teeth, preferably gear wheels, and in particular sprockets, so as to generate the workpiece thickness reduction in a respective tooth region, preferably across the radially outer tooth region or across the entire respective tooth region, between the tip of the tooth and the root of the tooth. In particular in the application of such an embossing step with toothed workpieces, and preferably sprockets, a lead-in chamfer on the tooth tip can thus be formed in a respective tooth region, which facilitates the meshing of the tooth tip into a respective chain link.

In a preferred embodiment, the invention can provide that at least one of the die parts, preferably however both the upper die part and the lower die part, has an oversized dimension in relation to the workpiece at least in a surrounding region around a respective tooth tip, whereby a distance region is formed between the workpiece sheared edge and the die part lateral surface, in which workpiece material is displaced during the workpiece thickness reduction.

In yet another complementary refinement, the method can provide that at least one of the die parts, again preferably the upper die part and the lower die part, has an undersized dimension in relation to the workpiece, beneath the aforementioned surrounding region of a respective tooth.

This refinement can be used to achieve, on the one hand, that the material of the workpiece, which is displaced so as to form the workpiece thickness reduction in the tooth tip region, is able to flow in those regions in which the above-described oversized dimension exists while, on the other hand, the angle of the tangent of the sheared edge with respect to the workpiece normal is reduced in those regions in which the undersized dimension exists.

In this way, the lead-in chamfer, which is used to facilitate the meshing of a chain tooth into a chain link, can be created in a respective tooth region of a workpiece comprising teeth, and in particular of a sprocket, at the location of the tooth tip, and additionally it is possible, in the region of the tooth root, to achieve contact across a large surface area over the entire workpiece thickness of the workpiece or sprocket in relation to the chain link axis.

In this way, force transmission between a respective tooth root region of the workpiece, and in particular a sprocket, and the chain link being engaged is optimized.

In a particularly preferred embodiment, it is achieved, as a result of the workpiece thickness reduction, that the final ready-to-use tooth geometry of the gear wheel, and in particular of a sprocket, is embossed between the die parts, so that a workpiece comprising teeth thus produced, and in particular a gear wheel, is directly ready for use after the process step of stamping, or preferably fine blanking, and the subsequent preferably only following embossing step, wherein particularly preferably, in this subsequent only embossing step, the die-roll-side rollover reduction takes place together with the burr-side burr rounding and, in the tooth tip regions, the radially outwardly increasing workpiece thickness reduction for the implementation of a lead-in chamfer is achieved and, in the tooth root region, the sheared edge or stamped edge is aligned within the meaning of an angular reduction between the tangent thereof and the workpiece normal.

The preferred embodiments of the invention are described in more detail in the following figures.

DETAILED DESCRIPTION OF THE INVENTION

Figure 1A:
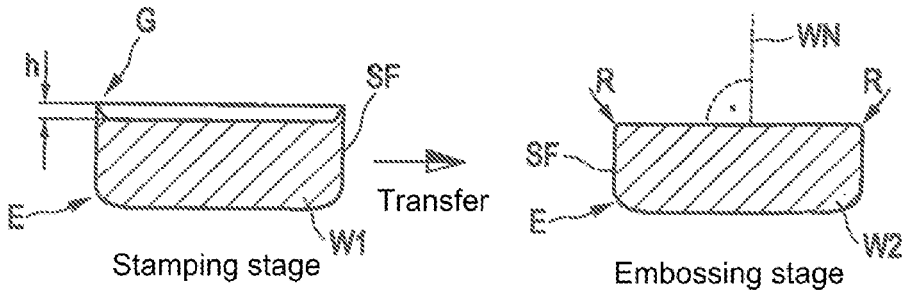
FIG. 1A PRIOR ART
FIGS. 1A and 1B are schematic representations of the prior art.
Figure 1B:
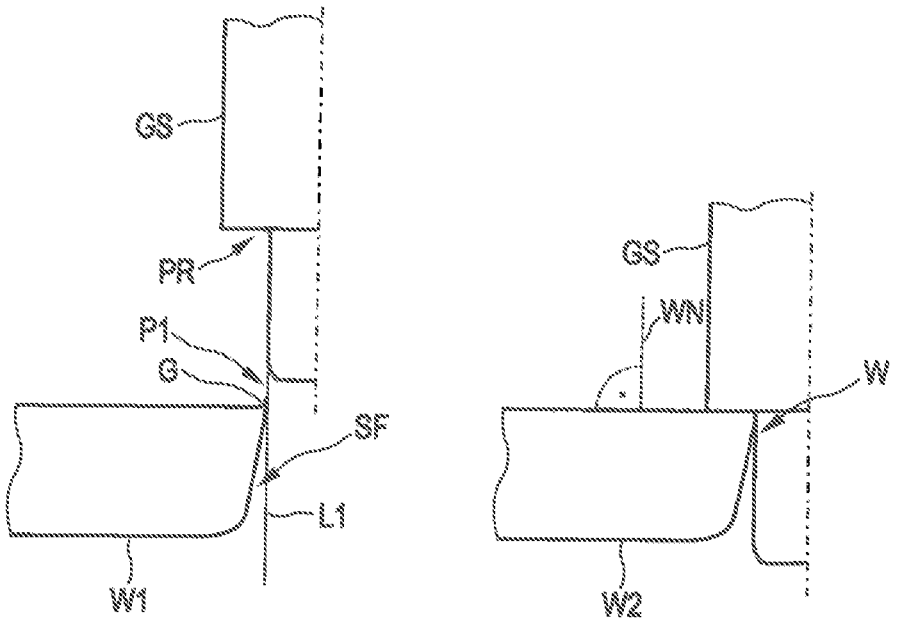
FIG. 1B PRIOR ART

FIGS. 1A and 1B show the existing prior art, essentially according to WO 97/32678 (U.S. Pat. No. 6,212,930) by the same applicant, for a comparison with the advantageous invention, which will be apparent later.

The workpiece W1 is apparent on the left side of FIG. 1A, which in this example was produced in the stamping stage of a fine blanking device. The rollover E, customary with fine blanking or with stamping in general, is apparent on the die-roll side, which is at the bottom here. On the burr side of the workpiece W1, which is at the top here, the typical burr G extends at a height h.

After stamping or fine blanking, the workpiece W1 is transferred into an embossing stage. Using a die, which is not shown in FIG. 1A, the burr G is rounded, using the radius R here, and with this step, workpiece W2 is produced from workpiece W1. The die-roll side, and in particular the height of the rollover E, remains unchanged here.

An orientation of the sheared edge SF not parallel to the stroke direction or workpiece normal is not illustrated in FIG. 1A, but always exists for reasons related to the design principle. This orientation remains unchanged in the prior art by the rounding of the burr, which represents only a minor forming step.

FIG. 1B shows the rounding of the burr in conjunction with a die GS. The workpiece W1, which is fine-blanked in this example, but optionally may only be stamped in the traditional manner, is shown on the left side of FIG. 1B; however, the non-parallel slanted position of the sheared edge SF is illustrated here as well, compared to FIG. 1A.

With an identical dimension or oversized dimension between the workpiece W1 and the die GS symbolized by the arrow P1 and the line L1, during the stroke, the die moves from the burr side over the workpiece and rounds the burr G by way of the embossment rounding PR, with which the lateral surface of the die transitions into the bottom surface of the die.

The identical dimension or oversized dimension exists here in the upper burr-side workpiece plane between the burr-side sheared edge and the inner die lateral surface. In this illustrated case, these are aligned along line L1.

The right side of FIG. 1B furthermore shows that the rounding of the burr, and the material displacement associated therewith, in addition to the rounded burr, also results in a bead, which in actuality causes an increase in the cross-sectional surface area of the embossed workpiece W1 just below the burr-side workpiece surface plane, as compared to the unembossed workpiece W1. It is furthermore apparent here that the slanted position of the sheared edge with respect to the normal of the workpiece surface is unchanged.

Overall, the embossed workpiece W2 thus shows considerable differences in geometry, and in particular differences in the surface area sizes of the burr-side and die-roll-side workpiece surfaces, as well as a non-parallel sheared edge SF with respect to the workpiece normal, so that a workpiece thus embossed requires a finishing operation, for example by way of a grinding process, to be ready for use.

Figure 2A:
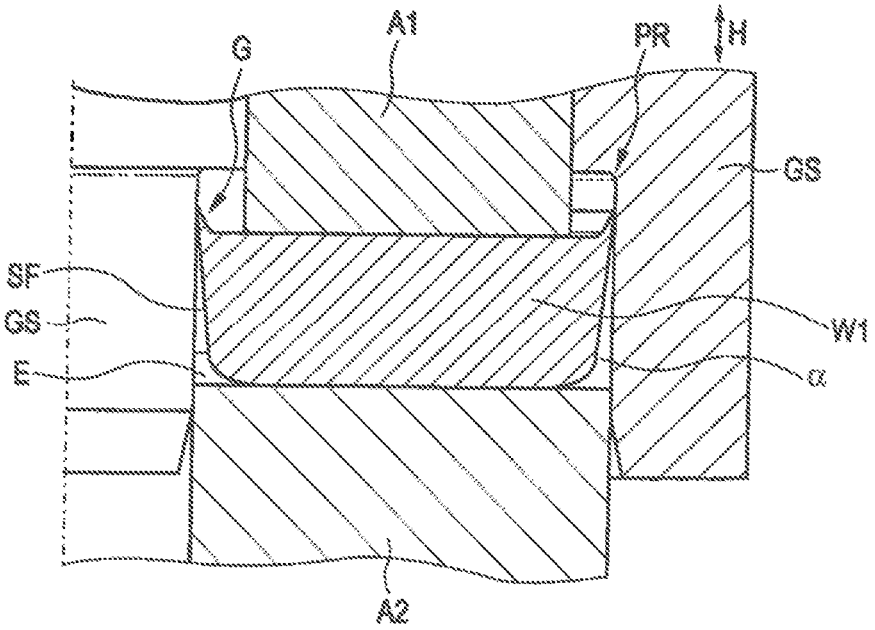
FIGS. 2A, 2B, 2C are schematic representations of an embodiment of the invention.
Figure 2B:
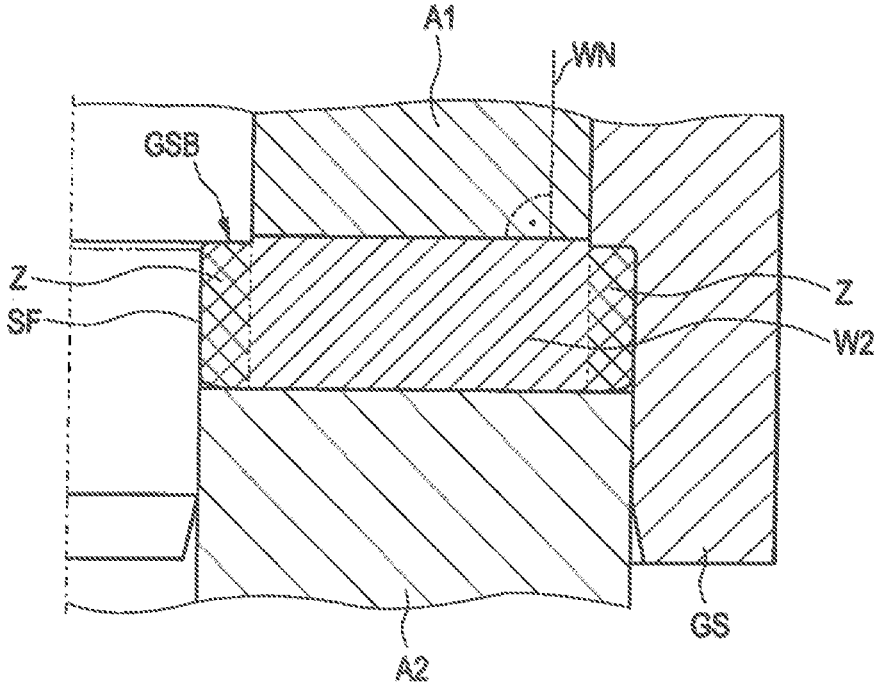

FIGS. 2A,2B show an embodiment of the invention.

According to FIG. 2A, the stamped or fine-blanked workpiece W1 is clamped between two ejectors A1 and A2. The die GS has a bell-shaped design here, surrounds the upper ejector A1, and can be moved in the stroke direction H relative to the two ejectors and the clamped workpiece W1 so as to carry out the embossing step.

Again, the rollover E, the burr G and the sloped sheared edge SF, which is not parallel to the normal, are apparent here. In FIG. 2A, the embossing device is open, which is to say the embossing step has not yet been carried out.

FIG. 2B shows the closed embossing device after the embossing step according to the invention has been carried out. The bell-shaped die GS has moved from the burr side over the burr G and has rounded the same in accordance with the embossment rounding PR.

According to the above definitions, the die has an identical dimension or oversized dimension in relation to the workpiece, however here this also causes a reduction, and preferably even an elimination, of the angle $\alpha$, which in this sectional view is enclosed between the sheared edge SF and the die lateral surface and corresponds to the angle, described in the hereinabove discussion of the prior art, between the aforementioned tangent on the sheared edge and the workpiece normal WN. This also results in a reduction in the rollover E.

It is apparent from FIG. 2B that the sheared edge SF rests against the die lateral surface, and thus the angle $\alpha$ has been eliminated here, and apart from the burr-side rounded edge and the edge of the workpiece having reduced rollover on the die-roll side, the sheared edge SF is thus parallel to the workpiece normal WN.

Both the rollover reduction and the angular reduction on the sheared edge here can be attributed to the die GS having moved, with the die bottom surface GSB thereof, in a closing stroke direction over the burr-side workpiece surface, and thus the thickness of the workpiece has been decreased by the die GS in an edge region along the cutting contour. This thickness reduction causes a material displacement in the axial direction and radially outwardly, whereby the angular reduction and rollover reduction are achieved. This may also result in strain hardening of the material in the zones Z close to the edge, radially inwardly in relation to the sheared edge SF.

Figure 2C:
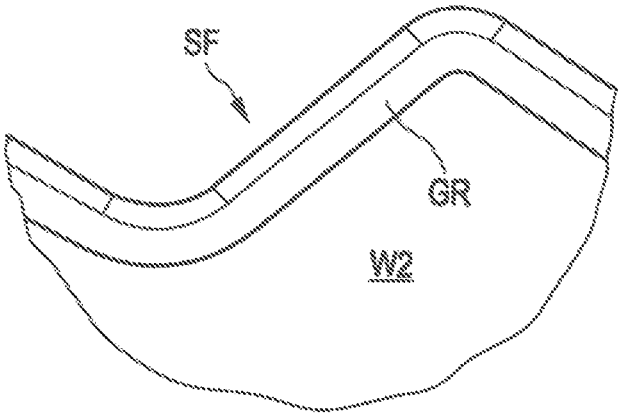

FIG. 2C shows a detail of the embossed edge GR on the burr-side workpiece surface. The width of the edge GR can preferably be in the range of 0.1 to 1 mm, for example. The thickness reduction of the workpiece thickness in this edge region can likewise preferably be 0.1 to 1 mm.

Here, the invention can furthermore provide that the radius of the embossment rounding PR is at least substantially identical to the height of the reduced rollover on the embossed workpiece W2.

This results in an embossed workpiece that, apart from the embossed edge, is substantially identical on the burr side and the die-roll side of the workpiece and has a sheared edge SF parallel to the workpiece normal WN. Such a workpiece W2 does not require any finishing. Grinding processes for adapting the workpiece to the desired geometry can thus be dispensed with.

Figure 3A:
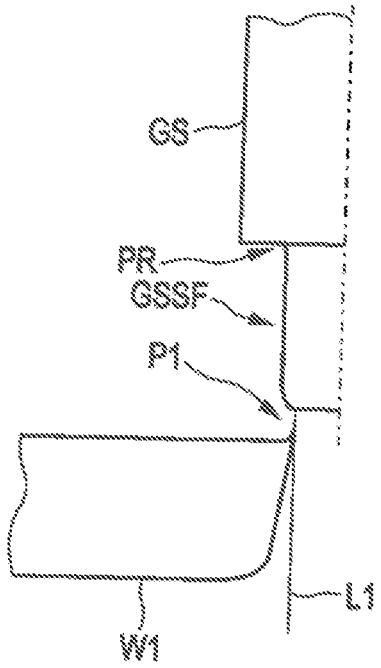
FIGS. 3A, 3B are schematic representations of another embodiment of the invention.
Figure 3B:
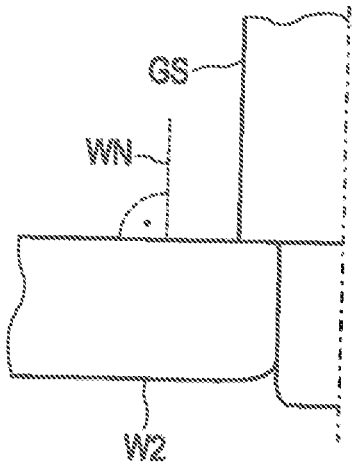

FIGS. 3A,3B show another embodiment of the method according to the invention, which can also be combined with the step of edge embossing according to FIGS. 2A, 2B.

Based on the line L1 and the arrow P1, FIG. 3A illustrates that the die GS has an undersized dimension in relation to the workpiece W1. Here, this results from the die lateral surface GSSF of the die being disposed radially inwardly in relation to the burr G, with the outer cutting contour shown here. In the case of an inner cutting contour, conversely the die lateral surface would be disposed radially outwardly in relation to the burr. Due to the abutment taper of the die GS directed toward the burr G, however, it is still possible to move the die over the workpiece W1 during the embossing stroke.

FIG. 3B shows the situation after the embossing stroke has been carried out. Here, the die has displaced material of the workpiece W1 radially inwardly and axially, and thereby has both decreased the rollover and reduced, or here eliminated, the angle of the sheared edge SF with respect to the die lateral surface GSSF. The die bottom surface here has moved only into the planes of the burr-side workpiece surface, so that no edge was embossed here, as is described in FIGS. 2A, 2B. Nonetheless, such edge embossing would additionally also be possible.

The reduction in the sheared edge angle and rollover height in this embodiment is thus primarily due to the effect of the undersized dimension between the die and the workpiece W1, so as to form the embossed workpiece W2, which is preferably directly ready for use without finishing.

The embossment rounding PR can also be selected here such that the rounded burr has a radius that at least substantially corresponds to the reduced rollover height. Preferably, deviations between this radius and the reduced rollover height of less than 25% are achieved.

Figure 4A:
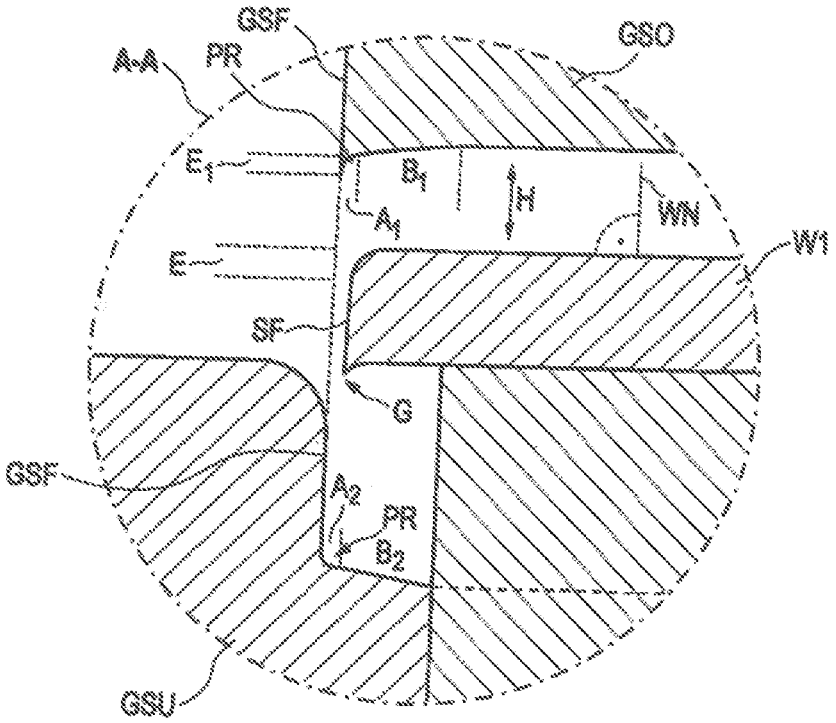
FIGS. 4A, 4B are schematic representations of yet another embodiment of the invention.
Figure 4B:
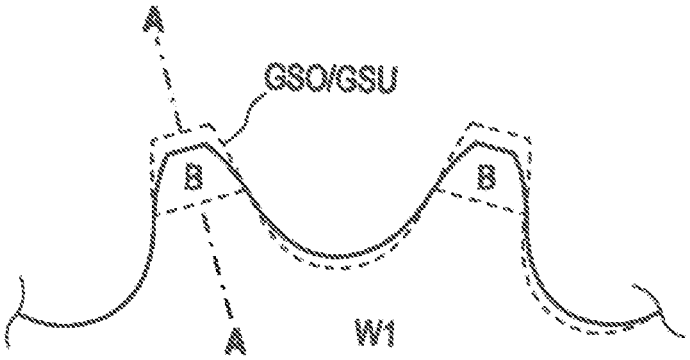

FIGS. 4A, 4B show a particularly preferred embodiment, which can be used, for example, with n-fold rotationally symmetrical workpieces, such as transmission disks or gear wheels, and preferably sprockets. It is likewise possible to produce non-symmetrical workpieces or such that comprise teeth only in sections, and in particular in at least one section of the stamped or fine-blanked circumferential contour. FIG. 4A shows a sectional view of the embossing device parallel to the stroke direction or parallel to the workpiece normal WN. The still unembossed workpiece W1 shown here again has a rollover having the height E, a burr G, and a sloped sheared edge SF non-parallel to the workpiece normal WN.

The workpiece W1 is surrounded by a die here, which comprises an upper die part GSO and a lower die part GSU. In the sections A1 and A2, the two die parts GSO and GSU each have an embossment rounding PR. The embossment rounding PR of the lower die part GSU is used to mash the burr using a desired radius, wherein the embossment rounding PR of the upper die part GSO limits the rollover reduction to the value E1 since material pressed during embossing is thus limited in terms of flow.

It is apparent in this sectional view A-A, which corresponds to the cutting plane A-A of FIG. 4B, that the die parts have an oversized dimension in relation to the workpiece W1 or the sheared edge SF thereof. It is apparent from the comparison with FIG. 4B, where the die is shown with dotted lines, that this oversized dimension is only present in a tooth tip region of a workpiece W1 comprising teeth, for example a workpiece comprising teeth only in at least a partial region, such as a seat adjustment element of a motor vehicle, or a workpiece W1 stamped or fine-blanked in the form of a gear wheel, and preferably a sprocket.

Both figures furthermore indicate an embodiment essential to the invention, according to which the distance between the two die parts in the stroke direction H decreases in the direction of the sheared edge, viewed from inside the workpiece. This reduction in the distance is present in the region B of both die parts which extends over the tooth tip according to FIG. 4B. This region may also extend over the entire tooth height, where necessary, but is at least provided in the tooth tip region.

This embodiment causes not only the burr G to be rounded and the rollover E to be decreased to E1 during embossing, but additionally implements a workpiece thickness reduction on the workpiece W1, with a thickness reduction, increasing from radially inside toward radially outside, on a respective tooth of the workpiece comprising teeth, and in particular a gear wheel. The material pressed out of the region B in the workpiece finds room in the spaced region between the sheared edge and the die lateral surface, due to the oversized dimension present there.

Such a thickness reduction which is generated in an identical manner both on the burr side and on the die-roll side on each tooth of the workpiece comprising teeth, and in particular a gear wheel, can form a lead-in region on the workpiece tooth for facilitated lead-in of the tooth into a respective chain link.

FIG. 4B furthermore shows that the die has, or the two die parts GSO and GSU have, an undersized dimension in the respective tooth root region or tooth base region, which is to say the die lateral surfaces GSF of the die parts are located inside the workpiece W1, viewed in the stroke direction.

As a result of abutment tapers, it is again made possible that the die, and in particular the lower die part GSU thereof, can move over the burr G of the workpiece during the embossing step, and thus embosses the same, and also reduces, or preferably eliminates, the angle of the sheared edge SF with respect to the workpiece normal through material flow. In this way, the sheared edge can be made parallel to the workpiece normal in the tooth root region, and in particular in the region that is, for example, up to 50% of the tooth height over the tooth root region, and in particular can thus improve the engagement between the tooth surfaces there and a chain link axis.

Preferably, this method variant also yields a workpiece that can be used immediately after the embossing step, in particular a workpiece comprising teeth, and preferably a sprocket, and requires no reworking or only reworking that is considerably reduced over the prior art.

The invention claimed is:

1. A method for producing a finished part having teeth, comprising:

producing a partially finished part having teeth by stamping or fine blanking a workpiece resulting in a burr on a first face of the partially finished part having teeth and a rollover on a second face of the partially finished part having teeth and a sheared edge extending between the burr and the rollover, the sheared edge forming an acute angle with the first face and an obtuse angle with the second face of the partially finished part having teeth;

providing an embossing device comprising an embossing die;

arranging the partially finished part having teeth in the embossing device for engagement of the partially finished part having teeth with the embossing die, and effecting a stroke of the embossing die in a direction orthogonal to the first and second faces of the partially finished part having teeth so that the embossing die engages the partially finished part having teeth;

wherein the embossing die comprises an annular first die part and arranged coaxially therewith a second die part configured to be received in the first die part with a sliding fit;

wherein a radially outermost interior diameter of the first die part is greater than a radially outermost diameter of the partially finished part having teeth and corresponds to a predetermined outermost diameter of the finished part having teeth;

wherein regions of at least one of the first and second die parts corresponding to regions of the partially finished part having teeth which are a root region of each tooth of the partially finished part having teeth and regions between the teeth of the partially finished part having teeth are undersized relative to said regions of the partially finished part having teeth;

wherein the first die part comprises a face facing the first face of the partially finished part having teeth and the second die part comprises a face facing the second face of the partially finished part having teeth;

wherein the respective faces of the first and second die parts facing the respective first and second faces of the partially finished part having teeth are so configured that distance between the respective faces of the first and second die parts continuously decreases in a radially outward direction over a radial distance corresponding to a predetermined annular region extending radially to the predetermined outer extremity of the finished part having teeth;

wherein the first die part has a lateral annular wall parallel to the axis of the embossing die and a transition between the annular wall and the face of the first die part facing the first face of the partially finished part having teeth has a radius of curvature corresponding to a predetermined radius of curvature of a transition from the first face of the finished part having teeth and lateral walls of the finished part having teeth;

wherein an annular outermost edge portion of the face of the second die part facing the second face of the partially finished part having teeth has a radius of curvature corresponding to a predetermined radius of curvature of a transition from the second face of the finished part having teeth and the lateral walls of the finished part having teeth and less than a radius of curvature of the rollover; and wherein during a stroke of the embossing die the second die part is received in the first die part with a sliding fit and material of which the partially finished part having teeth is constituted is displaced laterally and axially to completely fill spaces that existed between the partially finished part having teeth and the embossing die, and in the regions of the partially finished part having teeth corresponding to the undersized regions of at least one of the first and second die parts an angle of a tangent of edges of the part having teeth with respect to a normal of the part having teeth is reduced, the burr is mashed to conform to the curvature of the transition between the lateral annular wall of the first die part and the face of the first die part facing the first face of the partially finished part having teeth, and the rollover is engaged by the annular outermost edge portion of the face of the second die part facing the second face of the partially finished part having teeth and thereby shaped to conform to the curvature of the annular outermost edge portion of the face of the second die part facing the second face of the partially finished part having teeth, thereby to form a finished part having teeth having annular walls which are orthogonal to a radial plane of symmetry of the finished part having teeth first and second faces which converge continuously in a radially outward direction in the annular region extending radially to the outer extremity of the finished part having teeth.

2. The method according to claim 1, wherein the annular region corresponds to at least a tip region of each of the teeth of the part having teeth.

3. The method according to claim 2, wherein the annular region corresponds to the entirety of each of the teeth of the part having teeth.

* * * * *